United States Patent [19]

Anderson

[11] 4,214,639

[45] Jul. 29, 1980

[54] SUSPENDED DRILLING SYSTEM

[76] Inventor: Stanley J. Anderson, 10303 Channel Rd., Lakeside, Calif. 92040

[21] Appl. No.: 27,050

[22] Filed: Apr. 4, 1979

[51] Int. Cl.[2] ..... E21C 5/00; E21C 9/00; E21C 11/00

[52] U.S. Cl. ..... 173/43; 173/147

[58] Field of Search ..... 173/160, 147, 33, 38, 173/42, 43, 28

[56] References Cited

U.S. PATENT DOCUMENTS

| | | | |
|---|---|---|---|
| 3,550,693 | 12/1970 | Bermingham | 173/43 |
| 3,768,575 | 10/1973 | MacKinnon et al. | 173/43 |
| 3,881,555 | 5/1975 | Cresp | 173/43 |
| 4,102,094 | 7/1978 | MacKinnon | 173/43 X |

*Primary Examiner*—Ronald Feldbaum
*Attorney, Agent, or Firm*—Frank D. Gilliam

[57] ABSTRACT

A suspended drill system for drilling vertical holes in the ground at a distance from a supporting crane. A pivotable plate, attached to a crane boom point, has a first tube having a non-round cross-section attached thereto. A second tube (or plural telescoping tubes) vertically slidable in said first tube has a frame attached at the lower end. The frame is movable vertically by the crane hoisting cable. A drill stem extends downwardly of the frame and is rotated for drilling by an engine within the frame. This system allows drilling in unstable ground at a considerable distance above, below, or to the side of stable ground supporting the crane.

6 Claims, 6 Drawing Figures

SUSPENDED DRILLING SYSTEM

BACKGROUND OF THE INVENTION

This invention relates in general to devices for drilling holes in the ground and, more specifically, to a system for drilling holes at a considerable distance from the drill support structure.

A wide variety of earth drilling machines have been developed for drilling large and small diameter holes of various depths in different soils under widely varying conditions. While the prior systems have been able to overcome many drilling problems, none have been capable of efficiently drilling holes on unstable hillsides or unstable ground where no nearby stable surface for supporting a drilling rig is available.

Most commercial drilling rigs are designed to support a drilling head on a tower or boom extending vertically directly above the hole site. Typical of these are the arrangements disclosed by Burg et al. in U.S. Pat. No. 2,728,555 and Wilson in U.S. Pat. No. 3,191,450. Such devices are cumbersome, often requiring on-site assembly, and cannot be directly used on unstable ground or hillsides.

Portability of drill rigs has been improced by cantilevered crane- or truck-mounted drill rigs, such as are described by H. R. Smith in U.S. Pat. No. 1,895,901 and E. A. Smith in U.S. Pat. No. 1,971,922. In these cases, the drilling head can be extended in a cantilevered fashion beyond the end of the supporting vehicle. The extension distance is, however, quite limited, because, among other things, a horizontal bar extending from the vehicle to the drilling head must absorb the drilling torque. Also, the extension is primarily horizontal, so that drilling on hillsides above or below the support vehicle is difficult.

On a tower mounted drill, additional drilling pressure may be directly transmitted from the tower to the drill. On the cantilevered drill systems, the drilling pressure is limited to that provided by the drill and drilling head, which is often insufficient for rapid, efficient drilling in some soils.

Thus, there is a continuing need for improved systems for drilling at an increased distance from the support vehicle.

OBJECTS OF THE INVENTION

It is an object, therefore, of this invention to provide an earth drilling systems overcoming the above-noted problems.

Another object of this invention is to provide an earth drilling system capable of drilling at locations spaced a greater distance from the supporting vehicle above, below or to the side of the vehicle.

A further object of this invention is to provide a drilling system capable of bringing greater weight to bear on the drilling head.

SUMMARY OF THE INVENTION

The above objects, and other, are accomplished in accordance with this invention by a suspended drilling system comprising a plate pivotably attachable to the boom point of a crane or similar structure, a first tube (having an other-than-round cross-section) attached to said plate and vertically orientable, at least one second tube telescoped within said first tube, a frame attached to the lower end of said second tube, a means for raising and lowering said frame, a drill stem extending downwardly of the frame and an engine within the frame adapted to rotate the drill stem. Thus, holes can be drilled at any location which can be reached by the boom end.

The second tube, which acts as a torque tube to react drilling torque, is preferrably hollow and closed in a manner permitting it to be used as a fuel tank for the drilling engine. The weight of the fuel then presses down on the frame and drilling stem, to improve drilling speed and efficiency. Preferrably, the second tube consists of two or more telescoping tubes to provide variable length and variable fuel storage capacity.

BRIEF DESCRIPTION OF THE DRAWINGS

Details of the invention, and of a preferred embodiment thereof, will be further understood upon reference to the drawing, wherein.

DETAILED DESCRIPTION OF THE INVENTION

Figures 1, 4:
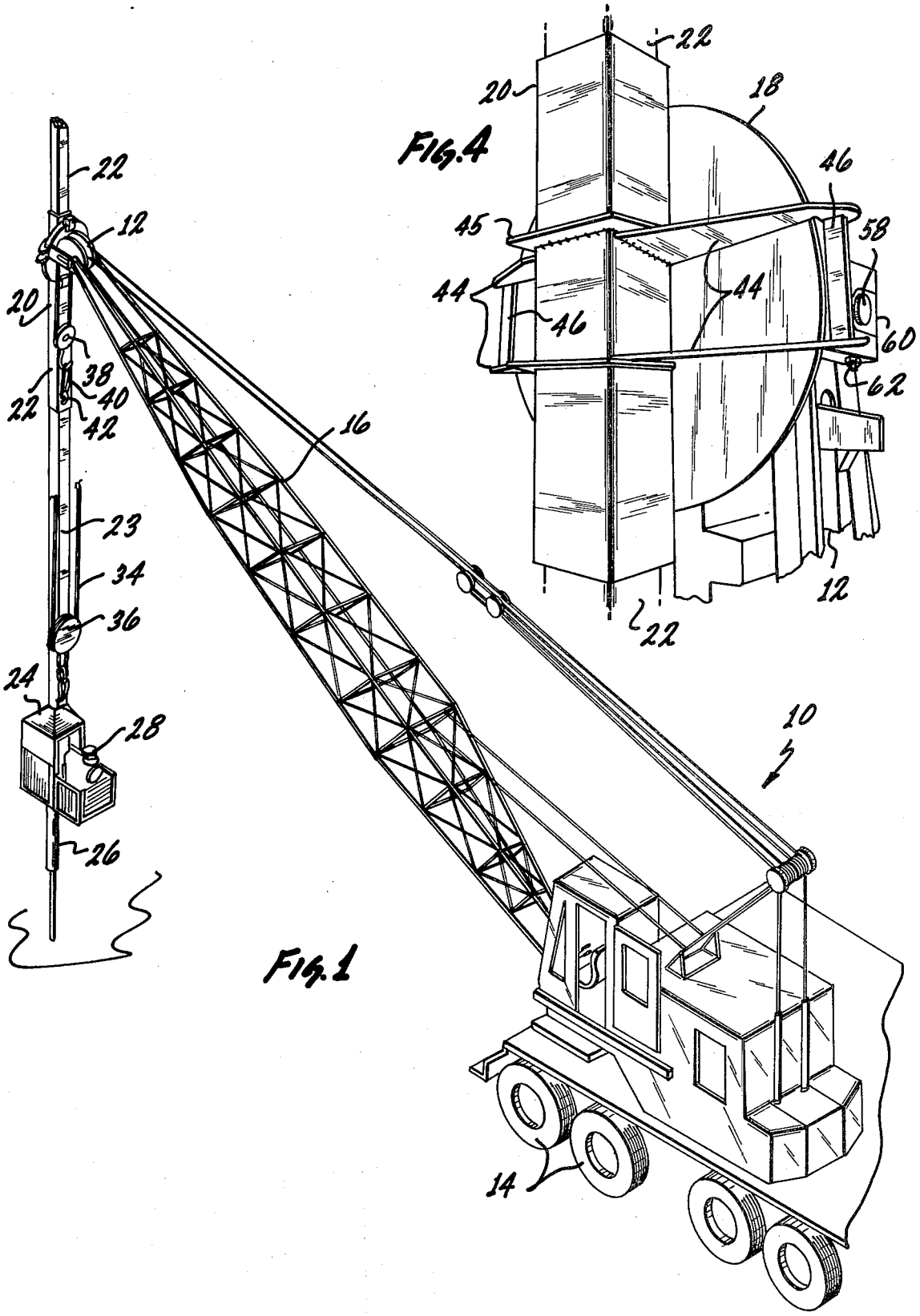
FIG. 1 is a perspective over-all view of the suspended drill system mounted on a crane.
FIG. 4 is a perspective view showing the telescoping support tube arrangement.

Referring now to FIG. 1, there is seen a conventional crane 10 having the suspended drilling system of this invention secured to boom point 12. While a conventional wheel mounted crane 14 is illustrated, any other support vehicle having an extendable boom may be used, if desired. Best results are generally obtained with a conventional crane, 75 ton or larger, as the support vehicle.

In the usual drilling operation, crane 10 is moved to a position with wheels 14 on stable, generally level, ground near the drill site, with boom 16 movable to position boom point 12 over the desired drilling site, which may be above or below the wheels 14 and may be on unstable ground.

Figure 2:
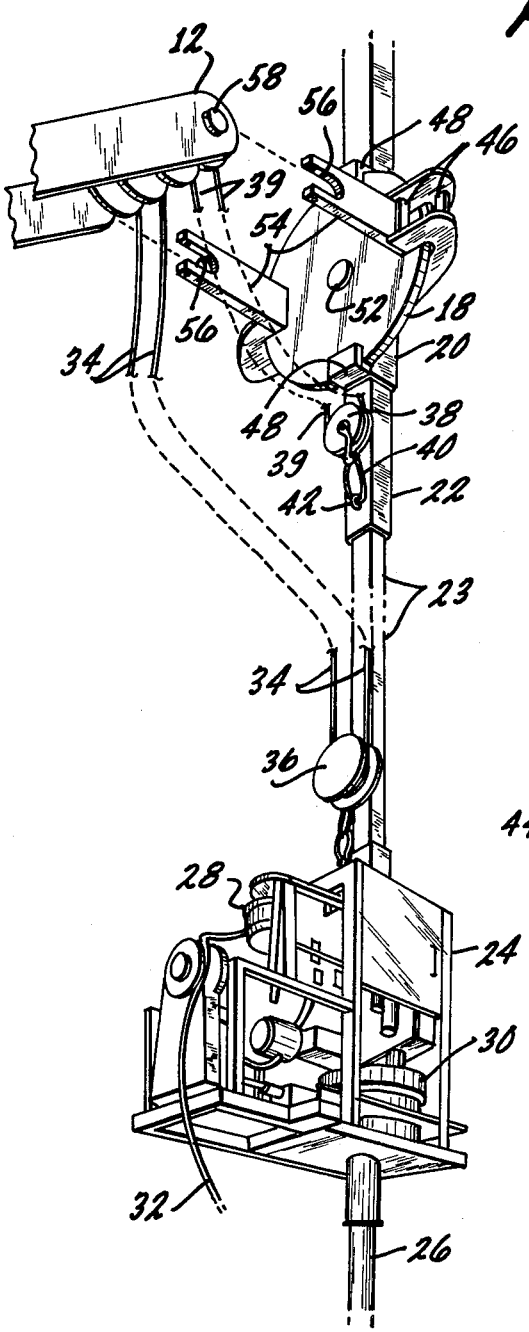
FIG. 2 is a perspective view, partially exploded, illustrating the attachment of the suspended drill system to a crane boom point.
Figure 3:
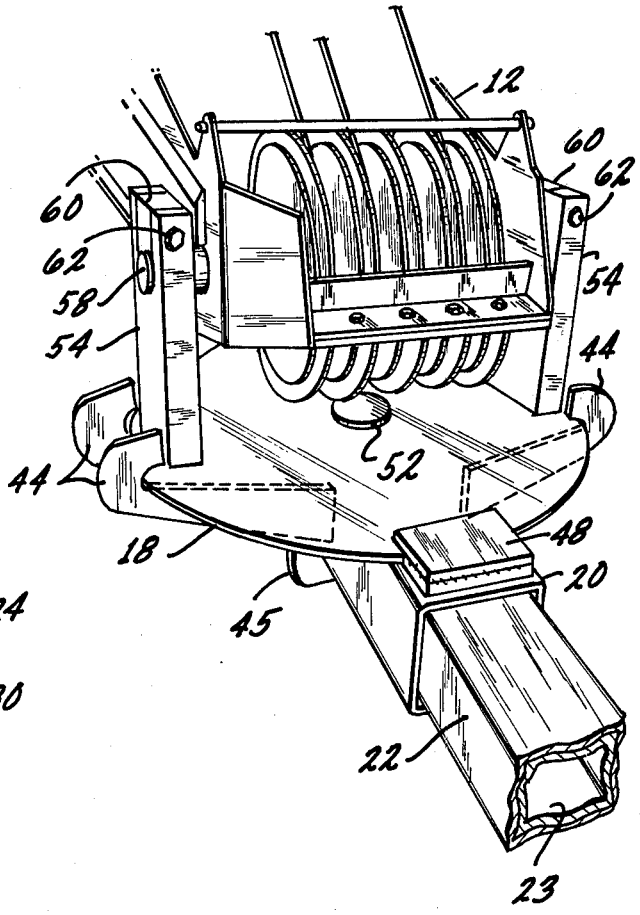
FIG. 3 is a perspective view, partially in section, showing the attachment plate means.

As seen in FIGS. 1 and 2, the basic components of the suspended drilling systems are a plate 18 pivotably attachable to boom point 12, a first tube 20 secured to plate 18, a tube assembly consisting of a second tube 22 telescoped with first tube 20 and a third tube 23 telescoped within second tube 22, a frame 24 secured to the lower end of third tube 23, a drill stem 26 extending downwardly from frame 24 and an engine means 28 within frame 24 to rotate drill stem 26 during drilling. Of course, tubes 22 and 23 could be replaced by a single tube, if desired.

Clearly, as drill stem 26 is rotated, an equal and opposite torque is induced through engine 28 to frame 24 and then tubes 22 and 23. Prior art cantilevered drill systems use a horizontal bar from the drill mount to the support vehicle to react that torque, severely limited drill capabilities. In the present case, tubes 22, 23 and 20, which have telescoping other-than-round cross-sections, act as torque tubes to react this torque. While any tube cross-section may be used, e.g., rectangular, eliptical, hexagonal, etc., the square configuration shown is preferred for simplicity and effectiveness.

Any conventional drill stem 26 and driving engine 28 may be used, as desired. For example, a 453 diesel engine from the General Motors Corporation may be used, operating througn an Allison three-speed transmission with an eight-to-one ratio low gear and a six-to-one ratio rotary table 30.

Engine 28 may be controlled in any conventional manner. If desired, an operator could ride within frame 24 to directly control engine 28. However, it is generally preferred that engine 28 be controlled from the ground near the drill site or from the cab of crane 10 through a conventional electrical or hydraulic control panel (not shown) connected to engine 28 through control cables 32.

Frame 24 is moved upwardly and downwardly before and during drilling by conventional crane hoisting cables 34 acting through first block 36.

A second block 38, operated from crane 10 independently of first block 36, is moved vertically by cables 39 to raise or lower second tube 22 by connecting cable 40 between block 36 and a pad eye 42 on second tube 22, as seen most clearly in FIG. 2. Thus, third tube 23 rises and falls with frame 24 as controlled by cables 34 and second tube 22 (telescoped over tube 23 and within tube 20) is raised and lowered under the control of block 38 and its associated cables to maintain the desired telescoping relationship among the tubes.

In an extreme case, such as where the drilling site is much lower than the crane support level, three or more telescoping tubes could be used in place of tubes 22 and 23. In that case, each of the tubes (except the innermost, which is secured to frame 24) would be supported and moved vertically by an arrangement similar to block 38 and pad eye 42, hoisted by a crane hoist cable.

Figure 5:
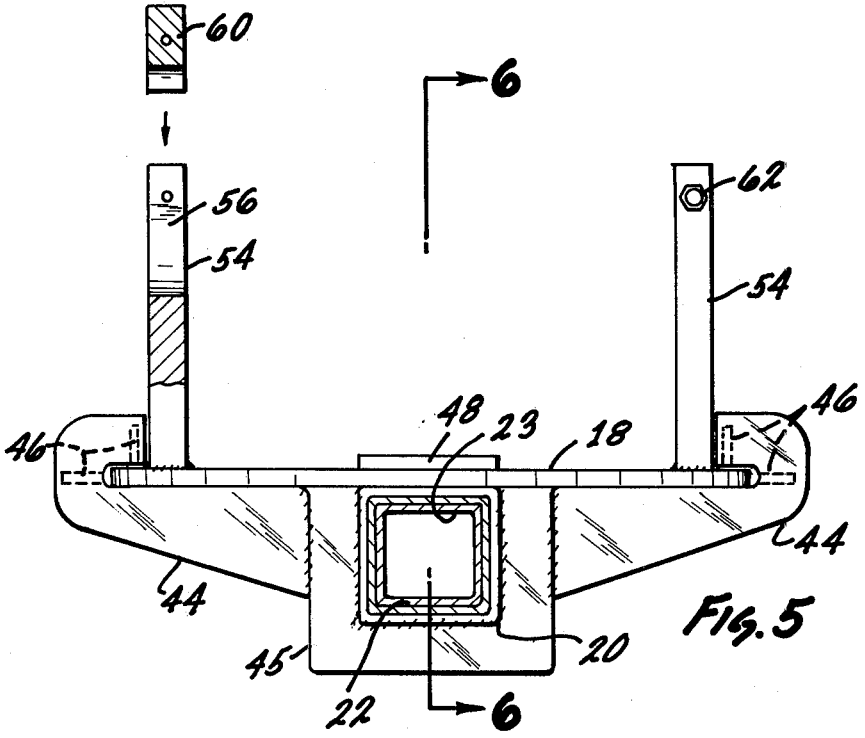
FIG. 5 is a plan view, partially in section, of the support plate attachment means.
Figure 6:
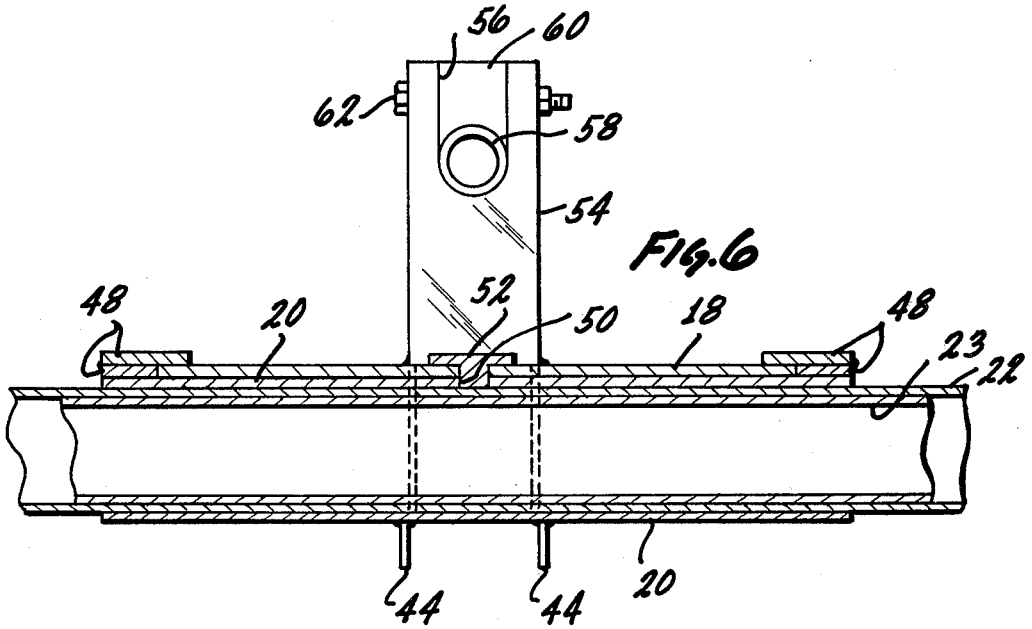
FIG. 6 is a section view taken on line 6—6 in FIG. 5.

The means for supporting the telescoping tubes 22 and 23 and for mounting plate 18 on boom point 12 are shown in detail in FIGS. 4–6. Hook-shaped brackets 44 are secured, such as by welding, to first tube 20 and extend to and around edges of plate 18 (which is preferrably round). Brace bars 46 maintain the hook-shaped ends of brackets 44 in the proper spaced relationship. Reinforcements 45 may be welded to tube 20 is necessary. The ends of brackets 44 closely surround the edges of plate 18, but are not bonded thereto. A pin 50, having a head 52 secured thereto, is fastened (such as by welding) in a hole in the wall of tube 22 and extends loosely through the center of plate 18. Thus, plate 18 is rotatable relative to tube 20 about pin 50 with the edge support of brackets 44 and 48. This pivotability facilitates vertical drilling even where crane 10 is not on level ground, since the tubes automatically assume a vertical orientation under the force of gravity acting on the weight of tubes, frames, etc., depending therefrom.

Plate 18 is mounted on boom point 12 by means of a pair of bars 54 (as seen in FIGS. 2, 3, 5 and 6) which are secured to plate 18, such as by welding. A U-shaped slot 56 in the end of each bar 54 is sized to fit over the extended ends of axle 58 in boom point 12. Filler blocks 60 are inserted after slots 56 are moved over axles 58 and are held in place by bolts 62 (as seen in FIGS. 4–6).

This suspended drill system is mounted on crane by laying the tube assembly horizontally on the ground with plate 18 horizontal and bars 54 pointing upwardly. Boom point 12 is lowered until axle ends 58 enter slots 56. Blocks 60 are inserted into slots 56 and bolts 62 are installed. Boom 16 is then raised slowly, lifting plate 18 and allowing tubes 20, 22 and 23 to swing to a vertical position. Since plate 18 can pivot about axle 58 in one plane and about pin 50 in the perpendicular plance, tubes 22 and 23 will always automatically assume a vertical position for drilling. Boom 16 is moved to locate drill stem 26 over the desired drilling site. Cables 34 are actuated to lower frame 24 to bring the drill into ground contact. Once drilling is well started, cables 34 may be slacked off, permitting the full weight of the assembly, including fuel within tubes 22 and 23 to bear on the drill, increasing drill speed and efficiency. Block 38 is moved as necessary to maintain an optimum telescoping relationship among tubes 20, 22 and 23. Thus, rapid, effective and convenient drilling can be accomplished at difficult sites well spaced from the support vehicle.

Certain specific components, arrangements and proportions have been described in conjunction with the above description of a preferred embodiment. These may be varied, or other components used, where suitable, with similar results. For example, the boom may be truck or barge mounted, or the boom may be of the horizontal type.

Other applications, variations and ramifications of the present invention will occur to those skilled in the art reading this disclosure. These are intended to be included within the scope of this invention, as defined by the appended claims.

I claim:

1. A suspended drill system which comprises:

a plate having means for pivotable attachment to a crane boom point;

a first tube having an other-than-round cross-section secured to said plate, said first tube adapted to assume a vertical orientation when said plate is attached to a crane boom point;

a second tube telescoped within said first tube and adapted to extend vertically above and below said first tube when said plate is attached to a crane boom point;

a frame attached to the lower end of said second tube;

means for connecting said frame to a hoisting cable of said crane whereby said cable supports said frame;

a drill stem extending downwardly of said frame for rotation relative thereto; and engine means within said frame for rotating said drill stem;

whereby a hole may be drilled anywhere within reach of said boom point.

2. The suspended drill systems according to claim 1 wherein said second tube acts as a torque tube preventing rotation of said frame as said drill stem is rotated and has a closed interior adapted to hold fuel for said engine means.

3. The suspended drill system according to claim 1 wherein said plate is substantially round and said first tube is secured to said plate by means permitting rotation of said first tube in the plane of said plate around the center of said plate.

4. The suspended drill system according to claim 1 wherein said second tube consists of at least two telescoping tube members extendible as said frame is lowered, with the lower tube member secured to said frame and the upper tube member supportable by a cable from said crane.

5. The suspended drill system according to claim 1 wherein said first and second tubes have square cross-sections.

6. The suspended drill system according to claim 1 wherein said plate is round and is rotatable about a pin secured to said first tube and extending through said plate; and further including at least two brackets secured to said first tube and extending over edges of said plate whereby said plate edges are supported as said plate is rotated relative to said first tube about said pin.

* * * * *